US010672369B2

(12) United States Patent
Hunsicker

(10) Patent No.: US 10,672,369 B2
(45) Date of Patent: Jun. 2, 2020

(54) ADAPTER FOR FINGER APPENDAGE OF BRASS INSTRUMENT

(71) Applicant: Wichita State University, Wichita, KS (US)

(72) Inventor: John Hunsicker, Wichita, KS (US)

(73) Assignee: Wichita State University, Wichita, KS (US)

( * ) Notice: Subject to any disclaimer, the term of this patent is extended or adjusted under 35 U.S.C. 154(b) by 0 days.

(21) Appl. No.: 16/416,998

(22) Filed: May 20, 2019

(65) Prior Publication Data

US 2019/0355333 A1 Nov. 21, 2019

Related U.S. Application Data

(60) Provisional application No. 62/674,077, filed on May 21, 2018.

(51) Int. Cl.
*G10D 7/10* (2006.01)
*G10D 9/04* (2020.01)

(52) U.S. Cl.
CPC ..... *G10D 7/10* (2013.01); *G10D 9/046* (2013.01)

(58) Field of Classification Search
CPC ..... G10D 7/10; G10D 9/046
See application file for complete search history.

(56) References Cited

U.S. PATENT DOCUMENTS 1,453,122 A * 4/1923 Benson ..... G10D 7/10 84/395
1,662,076 A 3/1928 Newman
2,734,417 A 2/1956 Hindsley
2,988,948 A 6/1961 Sash
3,433,114 A 3/1969 Seme
4,276,804 A 7/1981 Holland
5,644,095 A 7/1997 Davidson
7,335,831 B2 2/2008 Laukat et al.
7,396,985 B1 7/2008 Roth
8,278,540 B1 10/2012 Chen
9,255,815 B2 2/2016 Maldonado
9,595,246 B2 3/2017 Hagstrom
(Continued)

OTHER PUBLICATIONS

Zubin, John, et al., "Trumpet Ergonomics Redesign", Computer Graphics & Computer Aided-Design Project, George W. Woodruff School of Mechanical Engineering, Georgia Institute of Technology, Atlanta, Georgia, dated Spring 2011, pp. 50.
(Continued)

*Primary Examiner* — Robert W Horn
(74) *Attorney, Agent, or Firm* — Stinson LLP

(57) ABSTRACT

An adapter for the finger appendage of a brass instrument has an adapter body. An outboard side and an inboard side of the adapter body are spaced apart along a width. The adapter includes a fitting portion defining the outboard side of the adapter body and a spacer portion defining the inboard side of the adapter body. The fitting portion defines a mounting opening configured to receive the first portion of the adapter body to mount the adapter body on the finger appendage such that the spacer portion is received in the finger gap and the inboard side of the adapter body opposes the second portion of the finger appendage to define a reduced gap having a width that is less than the width of the finger gap.

20 Claims, 4 Drawing Sheets

(56) References Cited

U.S. PATENT DOCUMENTS

| | | | | |
|---|---|---|---|---|
| 2009/0320668 | A1* | 12/2009 | Jacobsen | G09B 15/06 84/470 R |
| 2016/0049138 | A1 | 2/2016 | Adkins | |
| 2019/0213981 | A1* | 7/2019 | Hunsicker | G10D 7/10 |
| 2019/0355333 | A1* | 11/2019 | Hunsicker | G10D 9/046 |

OTHER PUBLICATIONS

Payne, Sydney, "Music Professor Invents the Gapper, a Device to Aid in Playing the Trumpet", WSU News, Wichita Kansas, dated Jun. 2018, pp. 4.

* cited by examiner

ADAPTER FOR FINGER APPENDAGE OF BRASS INSTRUMENT

CROSS-REFERENCE TO RELATED APPLICATIONS

This application claims priority to U.S. Provisional Patent Application No. 62/674,077, filed May 21, 2018, and entitled "ERGONOMIC ADAPTER FOR BRASS INSTRUMENTS," which is hereby incorporated by reference in its entirety.

FIELD

The present disclosure pertains to an adapter for reducing the width of a gap of a finger appendage of a brass instrument.

BACKGROUND

Certain brass instruments include finger appendages at which the finger of a musician is placed during use. Finger appendages can take the form of hooks, rings, or saddles. Generally, a finger appendage defines a gap or space for receiving the musician's finger. The gap may have a width that is greater than the size of the musician's finger. This can lead to discomfort and can also make it difficult to use slides that are connected to the finger appendage to micro-tune the instrument. Musicians sometimes address oversized gaps by wrapping adhesive tape around portions of the finger appendage.

SUMMARY

In one aspect, a finger appendage of a brass instrument comprises a first portion and a second portion spaced apart by a finger gap having a width between the first portion and the second portion. An adapter for the finger appendage comprises an adapter body having an outboard side and an inboard side spaced apart along a width of the adapter body. The adapter includes a fitting portion defining the outboard side of the adapter body and a spacer portion defining the inboard side of the adapter body. The fitting portion defines a mounting opening configured to receive the first portion of the adapter body to mount the adapter body on the finger appendage such that the spacer portion is received in the finger gap and the inboard side of the adapter body opposes the second portion of the finger appendage to define a reduced gap having a width that is less than the width of the finger gap.

Other aspects will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
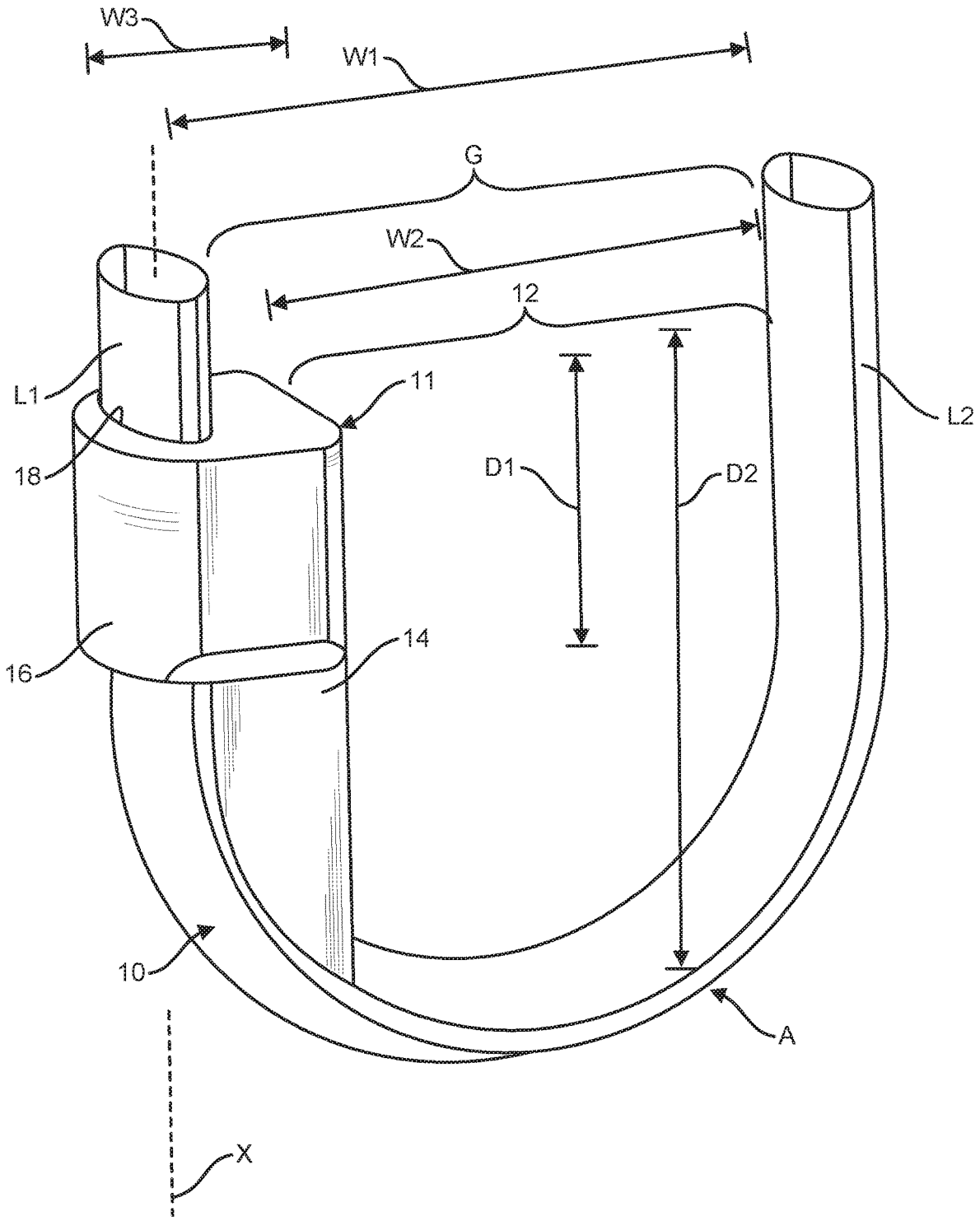
FIG. 1 is a perspective of an adapter mounted on a brass instrument finger saddle.

Referring to FIG. 1, one embodiment of an adapter for a brass instrument finger appendage A is generally indicated at reference number 10. In the illustrated embodiment, the adapter 10 is mounted on an appendage A that generally has the form of a saddle (e.g., a thumb saddle or a pinky saddle). It will, however, be understood that adapters can be used with other types of finger appendages (e.g., finger hooks, finger rings) in one or more embodiments. In general, the finger saddle A comprises a U-shaped body comprising a first leg L1 (broadly, a first portion) and a second leg L2 (broadly, a second portion). The legs L1, L2 are spaced apart from one another by a finger gap G having a width W1. In the illustrated embodiment, the legs L1, L2 are generally elongate and have lengths extending transverse to the width W1 of the gap G. The lengths of the illustrated legs L1, L2 are oriented generally parallel to one another, and each of the illustrated legs has a free end. Finger saddles having other configurations are also contemplated to be within the scope of this disclosure.

In general, the adapter 10 comprises an adapter body 11 that is configured to be mounted on the first leg L1 of the finger saddle A. When the adapter body 11 is mounted on the first leg L1, an inboard side of the adapter body opposes the second leg L2 to define reduced gap 12 between the adapter 10 and the second leg. The reduced gap 12 has a width W2 that is less than the original width W1 of the finger gap G. Thus, the adapter 10 can be used to reduce the amount of free space or play that is present when a musician's finger is placed in the saddle A. For example, in one or more embodiments, the adapter 10 is sized and arranged so that there is little to no free space between a musician's finger and the adapter body 11 and second leg S2. It will be understood, that adapters can come in different sizes to accommodate different sizes and shapes of musician fingers.

In the illustrated embodiment, the adapter body 11 comprises a spacer portion 14 that defines the inboard side of the adapter body and a fitting portion 16 that defines an opposite outboard side of the adapter body. The inboard and outboard sides of the adapter body 11 are spaced apart along a width W3. The adapter body width W3 extends in the same direction as the width W1 of the finger gap G when the adapter body is mounted on the saddle A as shown in FIG. 1. Throughout this disclosure, the terms "inboard" and "outboard" are used to describe relative positions in reference to the saddle A or other appendage. So for example, the "inboard" side of the adapter body 11 is located closer to the middle of the saddle A than the "outboard" side when the adapter 10 is properly mounted on the saddle.

In the illustrated embodiment, the adapter body 11 is formed from a single piece of monolithic material. That is, the spacer portion 14 and mounting portion 16 are formed together from a single piece of monolithic material. The adapter body 11 can be formed by molding, additive manufacturing, machining, or any other suitable manufacturing technique or combinations thereof. In an exemplary embodiment, the adapter body 11 is at least partially formed from a resiliently deformable (e.g., resiliently compressible and/or resiliently stretchable) material such as natural or synthetic rubber. Resiliently deformable material along the inboard side of the adapter body 11 can provide cushioning between the adapter body and the musician's finger. In addition, resiliently deformable material is useful for forming a friction fit between the fitting portion 16 and the first leg L1 of the saddle A in one or more embodiments. Although the illustrated adapter body 11 is formed from a single piece of monolithic, resiliently deformable material, other embodiments can be formed from more than one piece and/or other types of materials.

In general, the fitting portion 16 is configured to mount the adapter 10 on the first leg L1 of the saddle A so that the spacer portion 14 is received in the finger gap G and defines a reduced gap 12 with the opposite leg L2. In the illustrated embodiment, the fitting portion 16 defines a mounting opening 18 configured to receive the first leg L1 to mount the adapter body 11 on the finger appendage. The fitting portion 16 has a length D1 that extends along an axis X from an upper end (broadly, a first end) to a lower end L2 (broadly, a second end). (The terms "upper" and "lower" are used in this disclosure to describe the relative positions of features as shown in the drawings. It will be understood that the orientation of the adapter and finger appendage can vary depending on use.) The mounting opening 18 extends upward along the axis X from an open lower end that opens through the lower end of the fitting portion 16. In the illustrated embodiment, the mounting opening 18 extends along the axis X through an open upper end that opens through the upper end of the fitting portion 16. Thus, the illustrated mounting opening 18 comprises a through passage extending along the axis X through the fitting portion 16. It is also contemplated that one end (e.g., the upper end) of a mounting opening could be closed in one or more embodiments. In one or more embodiments, the fitting portion 16 of the adapter body 11 extends contiguously around an entire perimeter of the mounting opening 18 (e.g., circumscribes the entire perimeter of the mounting opening).

In an exemplary embodiment, the fitting portion 16 is configured to form a friction fit with the first leg L1 when the first leg is received in the mounting opening 18. In contrast to tapes that have been previously used to reduce the size of finger spaces in brass instrument appendages, the friction fit that connects the fitting portion 16 to the saddle A does not leave an adhesive residue on the instrument. As explained above, in certain embodiments, the fitting portion 16 is formed from resiliently deformable material. Thus, in certain embodiments, the mounting opening 18 is configured so that the fitting portion 16 is resiliently deformed by the first leg L1 being received in the mounting opening. For example, the mounting opening 18 can have a cross-sectional size (e.g., in a plane perpendicular to the axis X) that is slightly smaller than the cross-sectional size of the first leg L1. In an embodiment, the mounting opening 18 has a non-circular cross-sectional shape in a plane perpendicular to the axis X (e.g., the mounting opening can have an elongate cross-sectional shape and/or the mounting opening can have at least one cross-sectional flat) to inhibit rotation of the adapter body 11 about the first leg L1.

In the illustrated embodiment, the adapter body 11 is sized and arranged such that the spacer portion 14 substantially conforms to the inner perimeter of the saddle A. The spacer portion 14 has a length D2 that extends along the axis X from an upper end (broadly, a first end) to a lower end (broadly, a second end). The length D2 of the spacer portion 14 is greater than the length D1 of the fitting portion 16. In the illustrated embodiment, the upper end of the spacer portion 14 is generally flush with the upper end of the fitting portion 16, but it is also contemplated that the upper end of the fitting portion can be offset from the upper end of the spacer portion in one or more embodiments (see, e.g., FIG. 2). The lower end of the fitting portion 16 is offset from the lower end of the spacer portion 14 such that the illustrated adapter body 11 has an inverted L shape. The spacer portion 14 includes a protruding section that extends downward along the axis X away from the lower end of the fitting portion 16 to the lower end of the spacer portion. The protruding section of the illustrated spacer portion 14 has an outboard side that curves inwardly toward the inboard side of the adapter body 11 as the protruding section extends downward along the axis X. Hence, the protruding section has a width along the width W3 of the adapter body 11 that tapers as the protruding section extends downward along the axis X. The tapering protruding section is suitably sized and arranged to generally conform to the inner perimeter of the saddle A.

Figure 2:
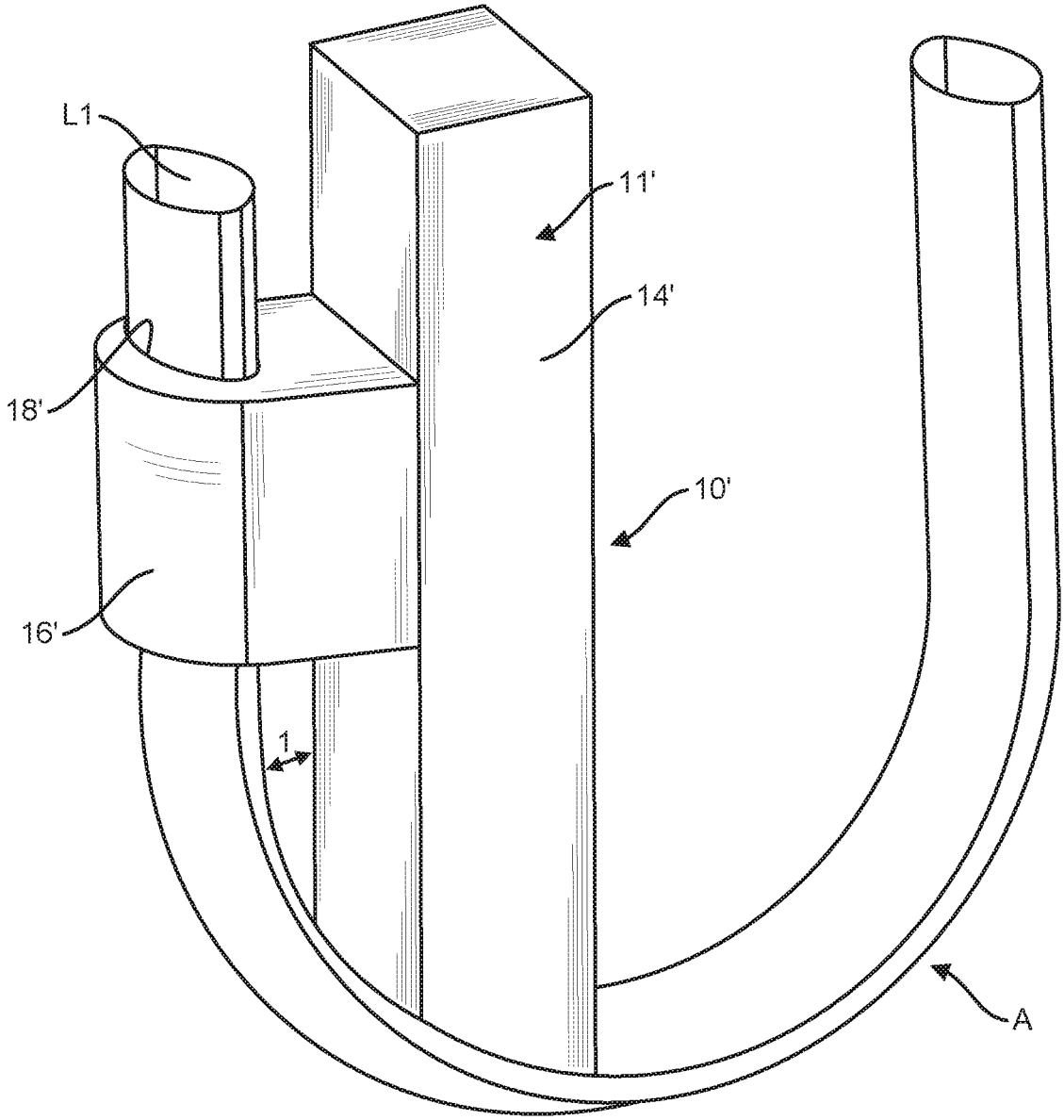
FIG. 2 is a perspective of another embodiment of an adapter mounted on the finger saddle.
Figure 3:
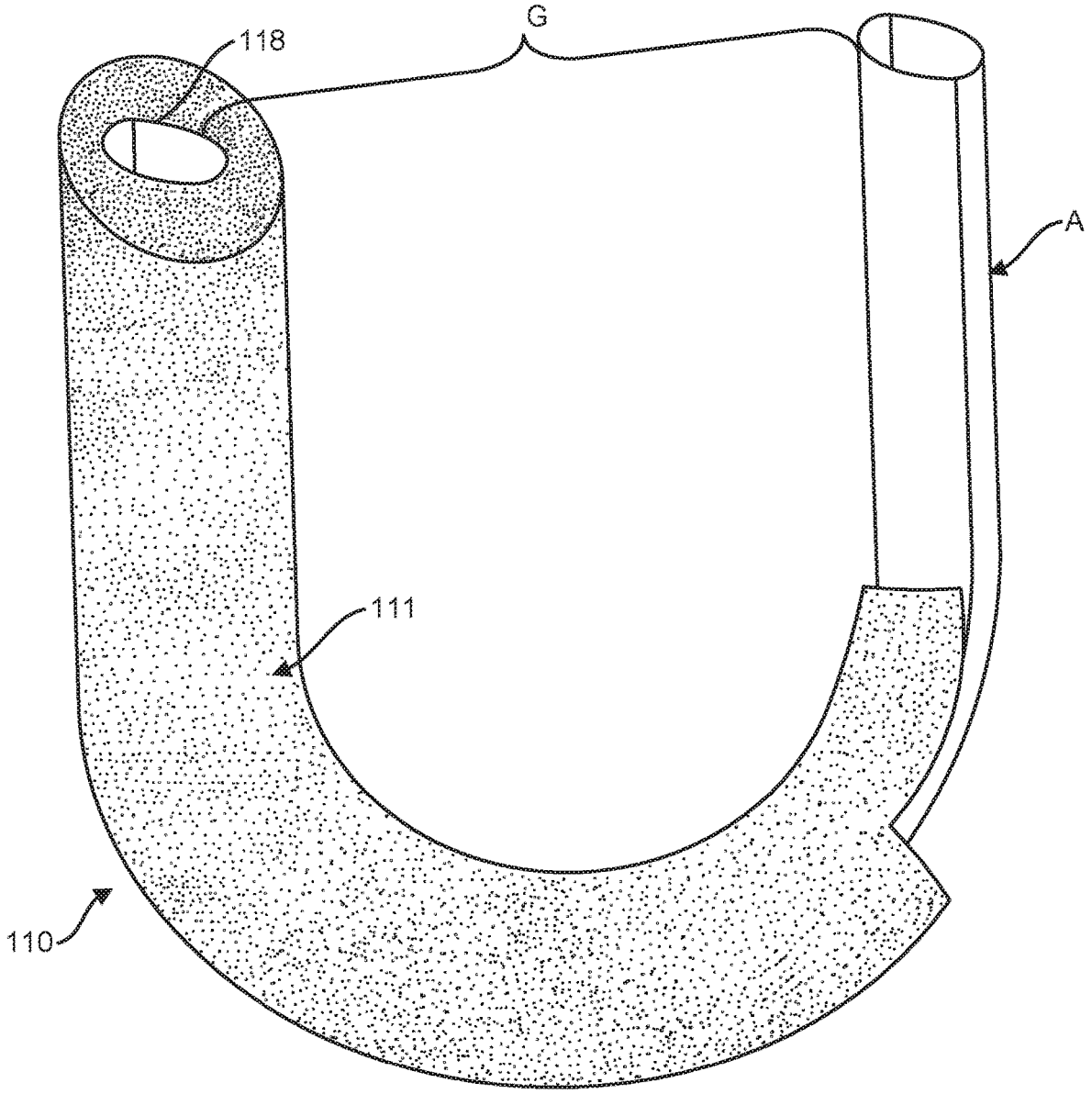
FIG. 3 is a perspective of another embodiment of an adapter mounted on the finger saddle.
Figure 4:
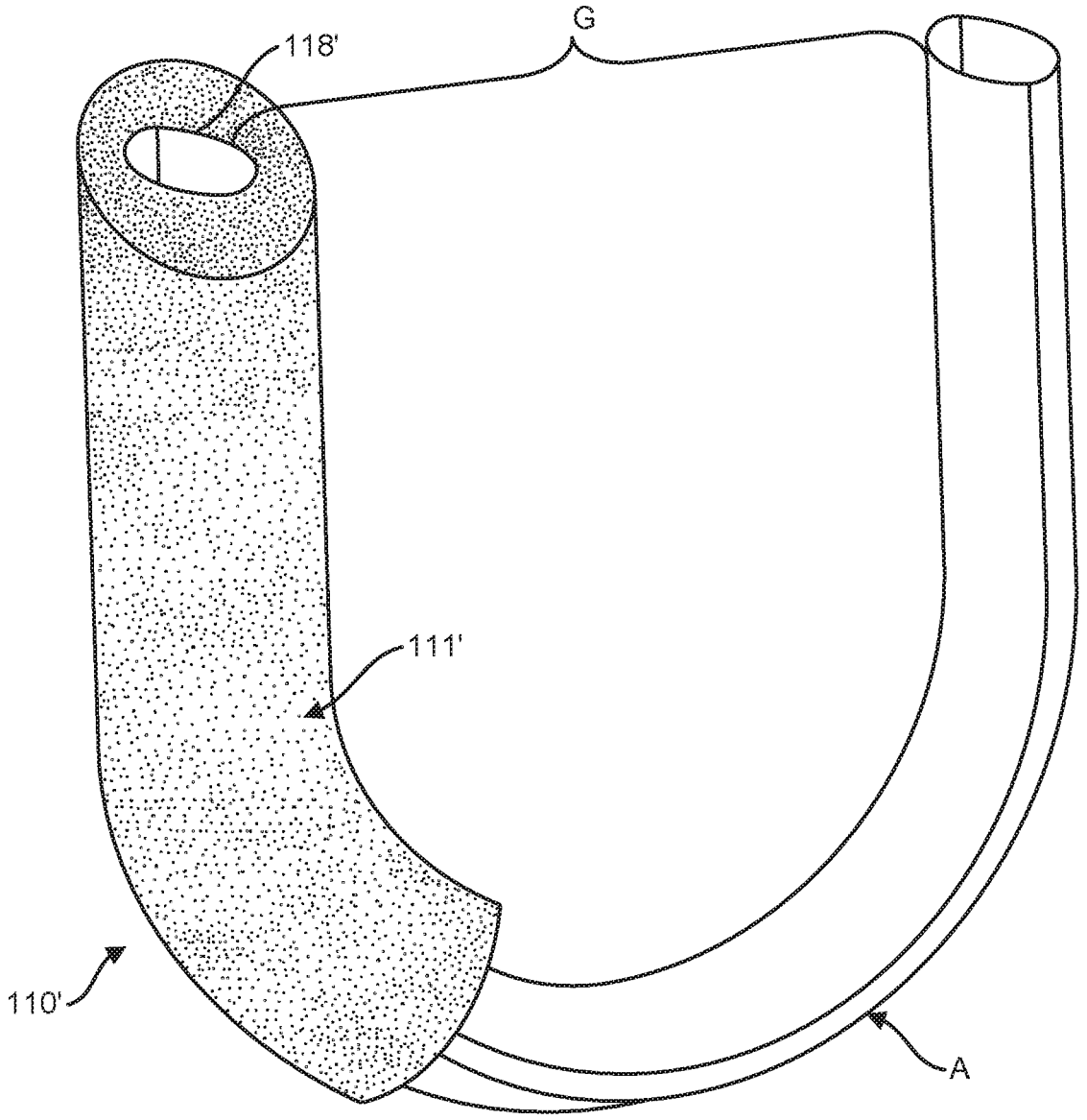
FIG. 4 is a perspective of another embodiment of an adapter mounted on the finger saddle.

Referring to FIG. 2, it is contemplated that an adapter 10' can have an adapter body 11' that is largely spaced apart from the inner perimeter of the saddle A in certain embodiments. The illustrated adapter body 11', for example, includes a spacer portion 14' that is spaced apart inboard from the inboard side of the mounting opening 18' formed in the fitting portion 16' such that the spacer portion is spaced apart widthwise from the first leg L1 of the saddle A on which the adapter 10' is mounted. Adapter bodies of still other shapes are also contemplated to be within the scope of the present disclosure. For example, referring to FIGS. 3 and 4, in one or more embodiments, an adapter 110, 110' comprises a respective adapter body 111, 111' comprising a sleeve (e.g., a monolithic, resiliently deformable sleeve) defining a respective mounting opening 118, 118' for receiving a portion of the saddle A therein to mount the respective adapter on the saddle. As can be seen, when each sleeve 111, 111' is mounted on the saddle A, it reduces the size of the gap G and, in some embodiments, provides a cushioned surface against which the musician can rest a finger.

Referring again to FIG. 1, it can be seen that the adapter 10 is configured to reduce the size of a gap G in a finger saddle A when the adapter is mounted on the finger saddle. The adapter body 11 defines a reduced gap 12 has a reduced width W2 that reduces the amount of free space or play that is present when a musician's finger is placed in the saddle A. When an adapter 10 of an appropriate size is chosen for a given musician, the adapter can substantially eliminate the free space or play that is present in the saddle A, while still providing a comfortable support for the musician's finger. Limiting the free space around the musician's finger can make it easier for the musician to use the saddle A to move slide valves to microtone the instrument. Further, when the adapter body 11 is formed from resiliently deformable, cushioning material, it can provide a relatively soft and comfortable point of contact between the musician's finger and the instrument. Moreover, in one or more embodiments, the adapter 10 can securely attach to the instrument without the need for any adhesives that may leave a residue.

When introducing elements of the embodiment(s) of this disclosure, the articles "a", "an", "the" and "said" are intended to mean that there are one or more of the elements. The terms "comprising", "including" and "having" are intended to be inclusive and mean that there may be additional elements other than the listed elements.

As various changes could be made in the above products and methods without departing from the scope of the disclosure, it is intended that all matter contained in the above description shall be interpreted as illustrative and not in a limiting sense.

What is claimed is:

1. An adapter for a finger appendage of a brass instrument, wherein the finger appendage comprises a first portion and a second portion spaced apart by a finger gap having a width between the first portion and the second portion, the adapter comprising an adapter body having an outboard side and an inboard side spaced apart along a width of the adapter body, the adapter including a fitting portion defining the outboard side of the adapter body and a spacer portion defining the inboard side of the adapter body, the fitting portion defining a mounting opening configured to receive the first portion of the adapter body to mount the adapter body on the finger appendage such that the spacer portion is received in the finger gap and the inboard side of the adapter body opposes the second portion of the finger appendage to define a reduced gap having a width that is less than the width of the finger gap.

2. The adapter as set forth in claim 1, wherein the fitting portion is configured to form a friction fit with the first portion of the finger appendage when the first portion of the appendage is received in the mounting opening.

3. The adapter as set forth in claim 1, wherein the mounting opening has a cross-sectional size that is smaller than the cross-sectional size of the first portion of the finger appendage.

4. The adapter as set forth in claim 1, wherein the adapter body is formed from resiliently deformable material.

5. The adapter as set forth in claim 1, wherein the adapter body is formed from a single piece of monolithic material.

6. The adapter as set forth in claim 5, wherein the adapter body is formed from resiliently deformable material.

7. The adapter as set forth in claim 1, wherein the mounting opening is configured such that the fitting portion is resiliently deformed by the first portion of the finger appendage being received in the mounting opening.

8. The adapter as set forth in claim 1, wherein the adapter body extends around an entire perimeter of the mounting opening.

9. The adapter as set forth in claim 1, wherein the fitting portion extends around an entire perimeter of the mounting opening.

10. The adapter as set forth in claim 1, wherein the fitting portion has a length extending along an axis oriented transverse to the width of the adapter body from a first end to a second end.

11. The adapter as set forth in claim 10, wherein the mounting opening extends generally along the axis.

12. The adapter as set forth in claim 10, wherein the mounting opening has a first open end through the first end of the fitting portion and a second open end through the second end of the fitting portion.

13. The adapter as set forth in claim 10, wherein the spacer portion has a length extending along the axis from a first end to a second end.

14. The adapter as set forth in claim 13, wherein the length of the spacer portion is greater than the length of the fitting portion.

15. The adapter as set forth in claim 14, wherein the first end of the fitting portion is generally flush with the first end of the spacer portion.

16. The adapter as set forth in claim 14, wherein the second end of the fitting portion is offset from the second end of the spacer portion.

17. The adapter as set forth in claim 16, wherein the spacer portion includes a protruding section that extends along the axis away from the second end of the fitting portion to the second end of the spacer portion.

18. The adapter as set forth in claim 17, wherein the protruding section has an outboard facing side that curves toward the inboard side of the adapter body as the protruding section extends along the axis away from the second end of the fitting portion.

19. The adapter as set forth in claim 17, wherein the protruding section has a width along the width of the adapter body that tapers as the protruding section extends along the axis away from the second end of the fitting portion.

20. The adapter as set forth in claim 1, wherein the mounting opening has a non-circular cross-sectional shape.

* * * * *